US005179807A

United States Patent [19]

Gupton

[11] Patent Number: 5,179,807

[45] Date of Patent: Jan. 19, 1993

[54] FLOOR SANDING DEVICE

[76] Inventor: Donald W. Gupton, 5884 Pontius Ct., San Jose, Calif. 95123

[21] Appl. No.: 793,173

[22] Filed: Nov. 18, 1991

[51] Int. Cl.[5] ..... B24D 15/00

[52] U.S. Cl. ..... 51/174; 51/393; 51/170 R

[58] Field of Search ..... 51/391, 392, 393, 180, 51/174, 175, 170 TL, 389, 390, 205 R, 205 W

[56] References Cited

U.S. PATENT DOCUMENTS

| | | | |
|---|---|---|---|
| 1,501,192 | 7/1924 | Severns | 51/392 |
| 1,562,415 | 11/1925 | Newman | 51/392 |
| 2,233,565 | 3/1941 | Whelan, Sr. | 51/392 |
| 2,251,329 | 8/1941 | Ekstrom | 51/170 TL |
| 2,711,059 | 6/1955 | Ames | 51/390 |
| 3,105,329 | 10/1963 | Sgorbati, Sr. | 51/205 R |
| 3,483,662 | 12/1969 | Ames | 51/392 |

FOREIGN PATENT DOCUMENTS

| | | | |
|---|---|---|---|
| 0683644 | 4/1964 | Canada | 51/392 |

*Primary Examiner*—Robert A. Rose
*Attorney, Agent, or Firm*—John J. Leavitt

[57] ABSTRACT

Presented is a floor sanding device having a relatively large shoe member on the bottom of which is attached a cushioning laryer adapted to receive an elongated strip of abrading material, such as sandpaper, for clamping to the shoe member. A handle is pivoted to the top surface of the shoe member and possesses a length sufficient to enable reciprocation of the floor sanding device by a workman from a standing position.

5 Claims, 1 Drawing Sheet

FLOOR SANDING DEVICE

BACKGROUND OF THE INVENTION

1. Field of the Invention

This invention relates to hand-operated floor sanding devices, and particularly to a floor sanding device for use in dressing the joints of underlayment panels of the type used under various floor covering materials, such as linoleum and asphalt tile.

2. Description of the Prior Art

There has been a long-felt need for smoothing the joints of the underlayment panels on which linoleum and tile floors are layed to prevent the "reflection" through the finished floor of imperfections or irregularities in the underlayment panels. The object sought to be achieved is a joint so smooth that it blends perfectly with the adjacent surfaces of the panels, which are frequently formed from plywood or particle board.

To achieve this purpose, various types of devices have been proposed, as indicated by the patents listed below, but none appear to have the simplicity, effectiveness and low cost of the sanding device forming the subject matter of my invention. The United States patents that I have found through a preliminary patentability and novelty search are as follows:

| | | |
|---|---|---|
| 1,501,192 | 1,993,571 | 2,434,581 |
| 3,105,329 | 3,123,946 | 3,483,662 |
| 4,516,361 | 4,517,700 | |

Most devices adapted for the purpose stated above, are of a small size, frequently having a "footprint" that does not extend across the breadth of the fast-drying filler material with which the joints between panels are covered, thus necessitating painstaking hand-work and an inordinate amount of time to achieve the smoothness required. Accordingly, one of the important objects of the present invention is the provision of a sanding device that is sufficiently large in its "footprint" to extend transversely across the entire width of the applied filler material.

It is quite common for workman installing a new linoleum or tile floor to have to support themselves on their knees while sanding the joints between adjacent panels. This is hard on the knees, even when wearing knee pads, and because the workman is so close to his work, it is difficult for him to secure an overall perspective of the smoothness of the floor or the joint that he is attemting to smooth. Accordingly, another object of the invention is the provision of a floor sanding device that may be operated while the workman is standing erect.

In a device designed for manipulation from a standing position, the extent of travel of the sanding shoe is greater than for conventional smaller sanding devices that are manipulated while the workman is on his knees. It is therefore another object of the present invention to provide a floor sanding device in which the shoe and handle for manipulating it are pivotally connected in such a way that the shoe and handle change their spacial relationship during the course of reciprocating manipulation so as to maintain the sanding shoe flat on the joint and panels being sanded A still further object of the invention is the provision of a floor sanding device in which the sole of the shoe on which the sandpaper is applied is resiliently cushioned.

Still another object of the invention is the provision of a floor sanding device in which the sole of the shoe is inclined in relation to the top surface of the shoe so as to facilitate sanding along a joint by both a pushing and pulling action on the handle, during which the relationship of the sole of the shoe to the surface being abraded changes from front to rear portions.

A still further object of the invention is the provision of a floor sanding device incorporating means for quickly and easily changing the sandpaper without the use of tools.

The invention possesses other objects and features of advantage, some of which, with the foregoing, are set forth in the following description and illustrated in the drawings. It is to be understood, however, that the invention is not limited to the embodiment illustrated and described, since it may be embodied in various forms within the scope of the appended claims.

SUMMARY OF THE INVENTION

In terms of broad inclusion, the floor sanding device of my invention includes a shoe member having upper and lower surfaces, the upper surface serving to pivotally attach an elongated handle that enables a workman to manipulate the device while in an upright attitude, rather than on his knees, as is the custom. The bottom surface of the shoe member, which is of large proportions in comparison to conventional sanding devices, is specially configured to cooperate with the natural body motions of an erect workman manipulating the device in either a pushing or pulling mode. Means are provided for securing a large piece of sandpaper or the like to the bottom surface without the need for tools, whereby reciprocating motion of the shoe member by the workman effects the sanding operation desired. Pushing the sanding device away from you when in a standing position results in greater sanding pressure being exerted by the forward portion of the shoe, while pulling on the sanding device results in greater sanding pressure being exerted on the thinner end of the shoe member.

DESCRIPTION OF THE PREFERRED EMBODIMENT

Figures 1, 2, 3, 4:
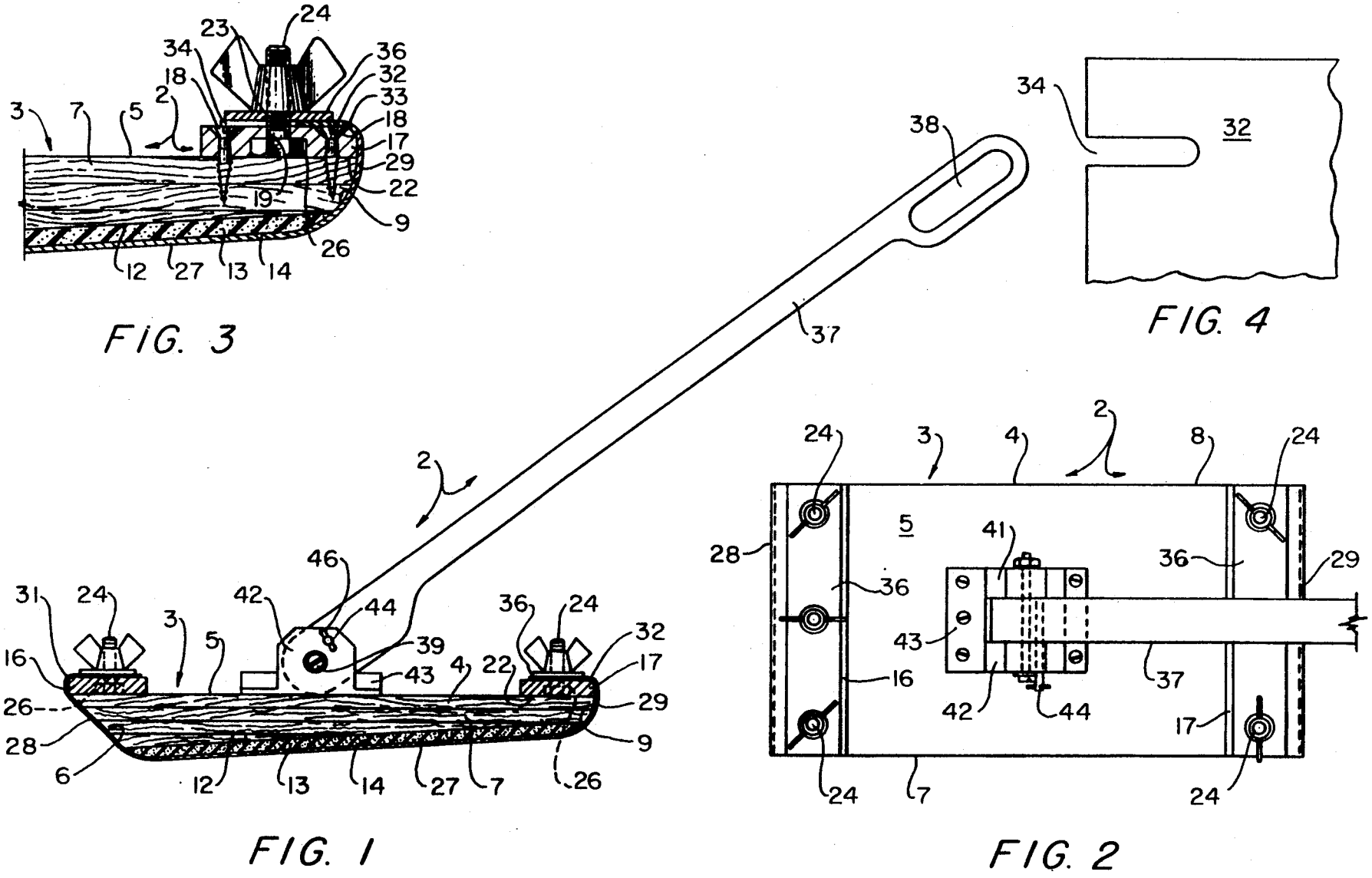
FIG. 1 is a side elevational view of my floor sanding device, shown in reduced scale.
FIG. 2 is a top plan view of my floor sanding device, a portion of the handle being broken away to reduce the length of the view.
FIG. 3 is a fragmentary enlarged cross-sectional view showing the means of attachment of the sandpaper to the sanding shoe.
FIG. 4 is a fragmentary plan view illustrating a portion of the slotted end of one attachment end portion of the sandpaper strip.

In terms of greater detail, referring to FIG. 1, the floor sanding device of the invention is designated generally by the numeral 2, and comprises a generally rectangular sanding shoe designated generally by the numeral 3, and fabricated from any suitable material, including wood, plastic or metal. The sanding shoe is large by comparison with conventional sanding devices, having a "footprint" that is about 21.5 inches long and 12 inches wide, thus presenting an exceptionally large area for attachment of an abrading medium. In the embodiment of the invention shown, the sanding shoe includes a rectangular plate 4, here formed from wood, but capable of being fabricated from plastic or metal, and having a generally rectangular top surface 5 bounded by a front edge 6, left and right side edges 7 and 8, respectively, and a rear edge 9.

The plate 4 is preferably about 1" thick at its forward end, and the front edge 6 is beveled rearwardly to form an acute angle with the top surface 5, and an obtuse angle with the bottom 12 of the plate. As seen in FIG. 1, the plate tapers rearwardly toward the rear edge 9, the plate at its rear end being only about one-half the thickness of the plate at its forward end.

Permanently mounted on the bottom surface 12 of the plate is a cushioning member 13 of uniform thickness from front to back, and extending from the front edge of the plate to its back edge as illustrated. At both its front and rear edges, the cushioning material, which may be a sheet of sponge rubber or a synthetic foam material, or a natural material such as the fibrous mat material over which some carpets are laid, for example, is feathered into the configuration of the front and rear edges of the plate so that there is presented a smooth transition from the undersurface 14 of the cushioning layer 13 and the associated end edge.

Secured to the top surface 5 of the shoe plate 4, adjacent the front and rear edges, are two bolt retainer bars 16 and 17, each securely fastened to the top surface of the shoe plate by appropriate screws 18 as shown in FIG. 3. The retainer bars extend transversely across the top surface of the shoe plate, and are provided with a plurality of aligned through bores 19 communicating with enlarged recesses 21 formed in the bottom surface 22 of each bar. The bores 19 receive the shanks 23 of bolts 24, while the enlarged recesses 21 receive the heads 26 of the bolts for a purpose which will be explained.

Detachably secured to the underside surface 14 of the cushioning layer 13 is an elongated strip 27 of sandpaper or similar sheet of abrading material. The strip of sandpaper is of equal width with the shoe plate 4 and cushioning layer 13, extending transversely so as to be flush with the longitudinal edges of the shoe plate and cushioning layer. Lengthwise, the sandpaper strip 27 is longer than the shoe plate, having sufficient length, as shown in the drawings, to pass around the front and rear ends 6 and 9 of the shoe plate in end portions 28 and 29, respectively. These end portions of the sandpaper strip are integral and continuous with attachment end portions 31 and 32 that pass over the elongated side edges of the bolt retainer bars 16 and 17, and then fold over the associated bar to lie flat upon the top surface 33 thereof as shown. Preferably, the sandpaper strip is pre-fabricated or pre-formed to the appropriate length, and at laterally spaced locations corresponding to the spacing of the bolts 24, the attachment end portions of the sandpaper strip are provided with slots 34 dimensioned in width to snugly receive the shanks of the bolts 24, and dimensioned in length to enable the sandpaper strip to be tensioned or pulled tautly about the ends of the shoe plate.

To detachably secure or anchor the attachment end portions of the sandpaper strip 27 to the shoe plate, and more precisely to the bolt attachment bars 16 and 17, there is provided superposed over each bar, and superposed over the attachment end portion of the sandpaper strip, a clamp bar 36 having apertures therealong corresponding in spacing with the bolts 24 so that the clamp bar may be placed atop the attachment end portions of the sandpaper strip as shown. Wing nuts 37, or other appropriate detachable fastening means, threadably engage the threaded shank portions of the bolts, and when tightened, press downwardly with sufficient force to tightly clamp the clamp bar against the surface of the underlying attachment end portions of the sandpaper strip.

To enable manipulation of the shoe plate from a standing or erect position of a workman, with sandpaper strip attached, there is provided pivotally secured to the top surface 5 of the shoe plate an elongated handle 37, having an eye 38 at its free end through which the fingers of one hand may extend for a secure grip. At its other or lower end, the handle is pivotally mounted by means of a pin 39 that extends through the lower end portion of the handle and through parallel lugs 41 and 42 projecting upwardly from a base plate 43 secured to the top surface of the shoe plate by appropriate means such as screws (not shown). The lugs 41 and 42 are spaced laterally sufficiently to receive the lower end of the handle, and the pivot pin 39 is positioned in the lugs so that the handle may be selectively pivoted through a wide arc during use.

However, in some instances, it is not desirable that the handle pivot during use. To secure the handle against pivotal movement, and to enable selective adjustable positioning and securement of the handle at different angles in relation to the plane of the top surface of the shoe plate, there is provided a lock pin 44 passing through the lower end of the handle and the associated support lugs 41 and 42. Adjustment of the angle of the handle in relation to the shoe plate is provided by a pair of slots 46 in the support lugs through which the lock pin 44 passes. The lock pin is threaded on one end, and a complementary nut 47, when tightened on the threaded end of the lock pin compresses the assembly of handle and support lugs to prevent pivotal movement of the handle. If adjustment is necessary, all that is required is that the lock pin be loosened, the handle pivoted within the arc permitted by the slots 46, and the lock pin re-tightened to again secure the handle against pivotal movement.

It will thus be seen that there is provided a floor sanding device that may conveniently be used by workmen of different stature, while in an upright position, to effect smoothing of long joints in the underlayment panels, without having to work on their knees, and in a manner to achieve a better result in less time than is conventionally the case.

Having thus described the invention, what is believed to be new and novel and sought to be protected by letters patent of the United States is as follows.

I claim:

1. A floor sanding device for actuation by a workman from an erect attitude and adapted to receive and support an abrading medium, comprising:

a) a shoe plate having top and bottom surfaces intercepted by front and rear end edges, said shoe plate diminishing in thickness from said front end edge to said rear end edge and said bottom surface being shorter than said top surface;

a) an elongated handle pivotally mounted on the top surface of said shoe plate intermediate the front and rear end edges thereof whereby the sanding device may be reciprocated on a floor by a workman standing in an erect attitude; and a) clamp means mounted on the top surface of said shoe plate adjacent the front and rear end edges thereof and selectively manipulable to retain an abrading medium mounted on the bottom surface of said shoe plate.

2. The floor sanding device according to claim 1, wherein said front end edge of said shoe plate is beveled rearwardly from said top surface to intercept said bottom surface whereby said bottom surface commences rearwardly of said top surface.

3. The floor sanding device according to claim 1, wherein said rear end edge of said shoe plate is arcuate in its configuration.

4. The floor sanding device according to claim 1, wherein said clamp means comprises bolt retention bars mounted on the top surface of said shoe plate adjacent said front and rear end edges, a plurality of bolts projecting from each said bolt retention bar, a clamp bar mounted on said bolts and selectively movable into or out of engagemnt with said abrading medium, and means on said bolts manipulable to tightly clamp said abrading medium between said clamp bar and said bolt retention bar.

5. The floor sanding device according to claim 1, wherein a layer of cushioning material is secured to said bottom surface of said shoe plate, and said abrading material overlies said layer of cushioning material, said beveled front end edge and said arcuate rear end edge of said shoe plate.

* * * * *